US009930952B2

(12) United States Patent
Kim

(10) Patent No.: US 9,930,952 B2
(45) Date of Patent: Apr. 3, 2018

(54) COMPACT TYPE OF AIRTIGHT COSMETIC CONTAINER

(71) Applicants: CTK CO., LTD, Seocho-gu, Seoul (KR); Jin Woo Kim, Gwangmyeong-si, Gyeonggi-do (KR)

(72) Inventor: Jin Woo Kim, Gwangmyeong-si (KR)

(73) Assignee: CTK CO., LTD., Seongnam-si, Gyeonggi-Do (KR)

( * ) Notice: Subject to any disclaimer, the term of this patent is extended or adjusted under 35 U.S.C. 154(b) by 278 days.

(21) Appl. No.: 14/428,960

(22) PCT Filed: Aug. 6, 2013

(86) PCT No.: PCT/KR2013/007069
§ 371 (c)(1),
(2) Date: Mar. 17, 2015

(87) PCT Pub. No.: WO2014/084479
PCT Pub. Date: Jun. 5, 2014

(65) Prior Publication Data

US 2015/0320174 A1 Nov. 12, 2015

(30) Foreign Application Priority Data

Nov. 27, 2012 (KR) ..... 10-2012-0135222

(51) Int. Cl.
*A45D 33/02* (2006.01)
*A45D 33/00* (2006.01)
(Continued)

(52) U.S. Cl.
CPC ..... *A45D 33/006* (2013.01); *A45D 33/24* (2013.01); *A45D 40/22* (2013.01); *A47G 19/00* (2013.01);
(Continued)

(58) Field of Classification Search
CPC .... A45D 33/006; A45D 33/06; A45D 33/003; A45D 33/025; A45D 33/22; A45D 33/24;
(Continued)

(56) References Cited

U.S. PATENT DOCUMENTS 1,590,734 A * 6/1926 Calnan ..... A45D 33/006 132/299
1,647,004 A * 10/1927 Hyde ..... A45D 33/006 132/296
(Continued)

FOREIGN PATENT DOCUMENTS

KR 20-0423018 Y1 8/2006
KR 10-2011-0040507 A 4/2011
KR 10-1073436 B1 10/2011

*Primary Examiner* — Todd E Manahan
*Assistant Examiner* — Brianne Kalach
(74) *Attorney, Agent, or Firm* — John K. Park; Park Law Firm

(57) ABSTRACT

Disclosed herein is a compact type of airtight cosmetic container. A shoulder cap (40) to which a mesh is coupled and a puff storage cap (50) which stores a puff are successively placed onto and coupled to a medial body (30) which contains a cosmetic therein. The shoulder cap and the puff storage cap can be airtightly coupled to the medial body by a sealing member (51) provided under the puff storage cap and a sealing ring (43) provided in the lower surface of the shoulder cap. A pressurizing means pressurizes the puff storage cap onto the medial body such that the sealing member and the sealing ring are compressed, whereby the sealability of the cosmetic container can be enhanced so that leakage of powder or a cosmetic change attributable to water evaporation can be reliably prevented.

5 Claims, 6 Drawing Sheets

(51) Int. Cl.

| | |
|---|---|
| ***A45D 40/22*** | (2006.01) |
| ***A45D 33/24*** | (2006.01) |
| ***A47G 19/00*** | (2006.01) |
| ***A47G 23/02*** | (2006.01) |

(52) U.S. Cl.
CPC .... *A47G 23/0258* (2013.01); *A45D 2200/051* (2013.01)

(58) Field of Classification Search
CPC ..... A45D 33/10; A45D 33/16; A45D 33/08; A45D 33/02
See application file for complete search history.

(56) References Cited

U.S. PATENT DOCUMENTS

| | | | | |
|---|---|---|---|---|
| 7,337,787 | B2 * | 3/2008 | Matsuoka | A45D 33/02 132/307 |
| 2009/0272399 | A1 * | 11/2009 | Kim | A45D 33/008 132/293 |
| 2012/0103986 | A1 * | 5/2012 | Wang | B65D 47/265 220/260 |

* cited by examiner

[Fig. 1]
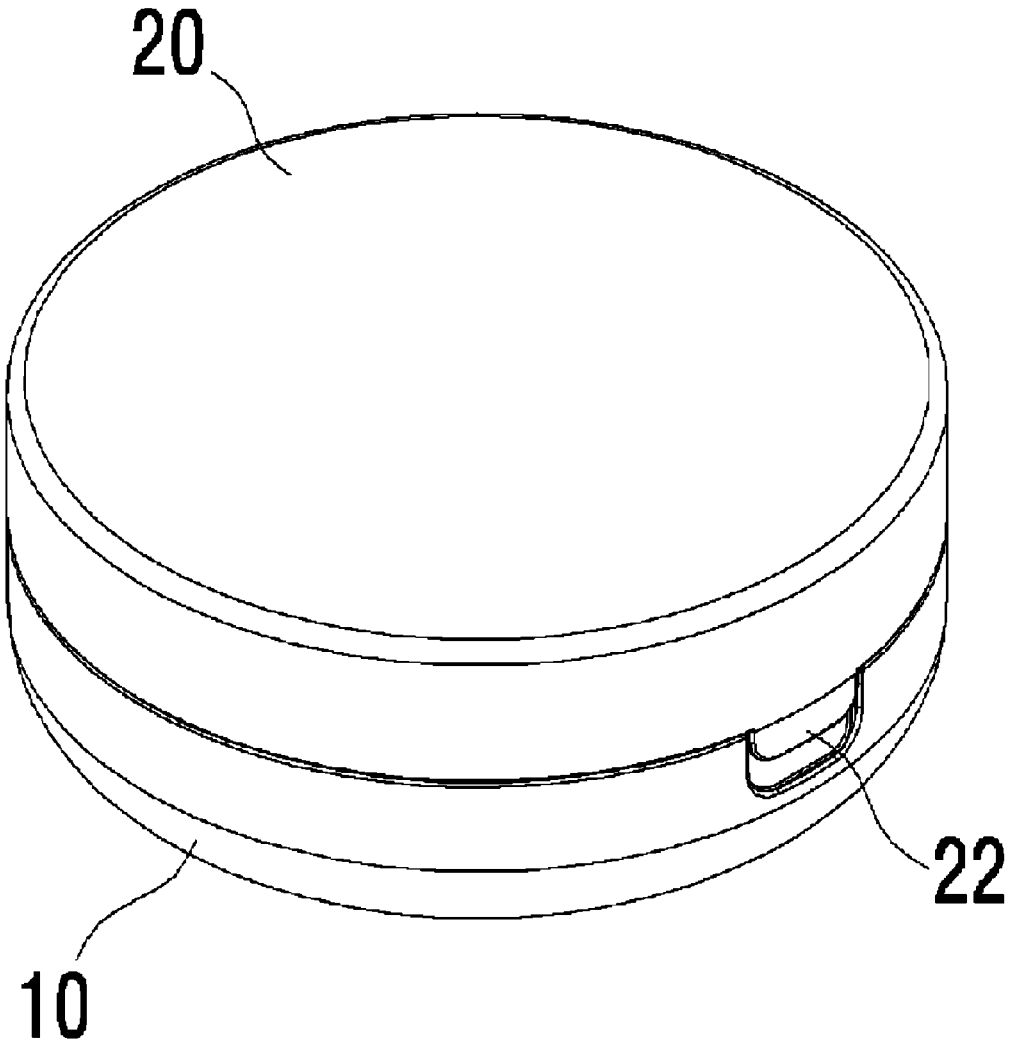

[Fig. 2]
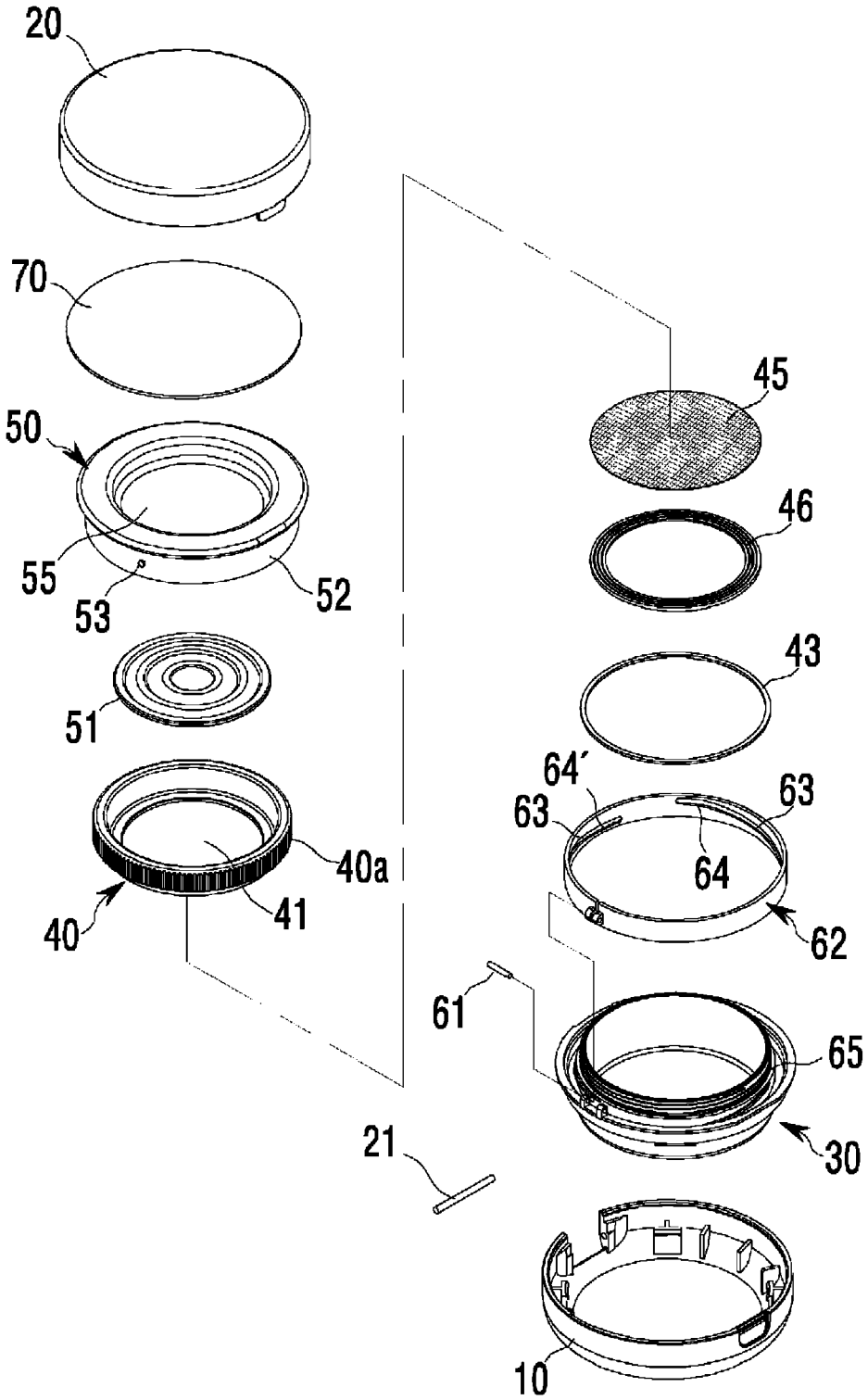

[Fig. 3]
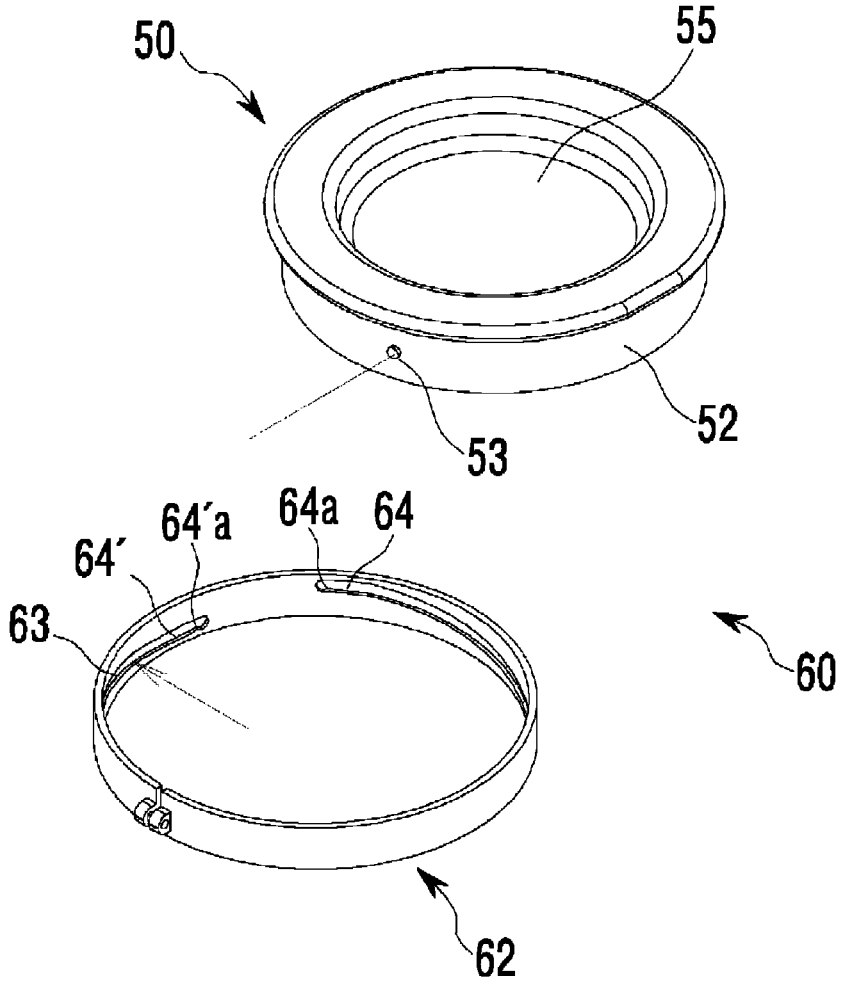
[Fig. 4]
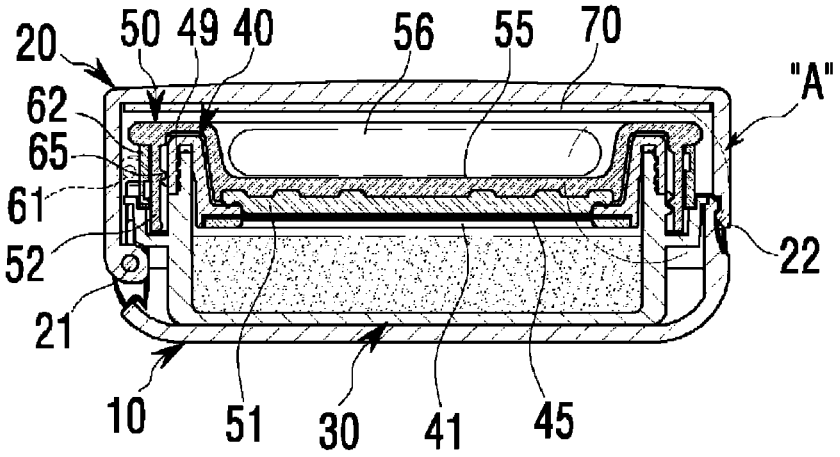

[Fig. 5]
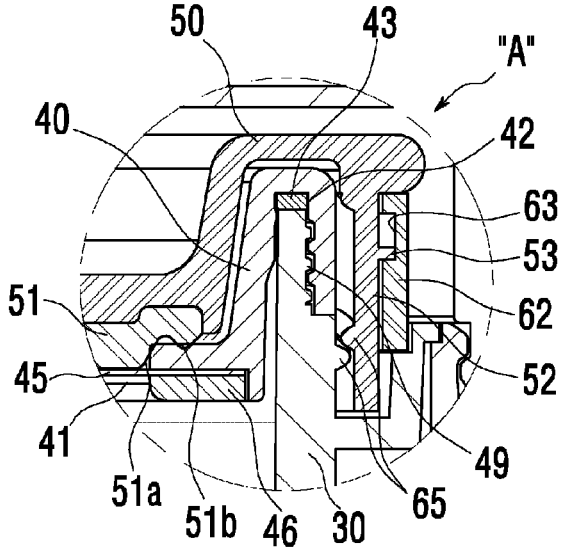
[Fig. 6]
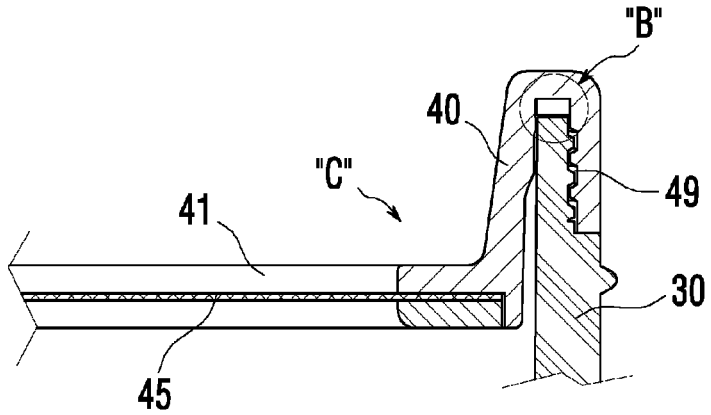
[Fig. 7]
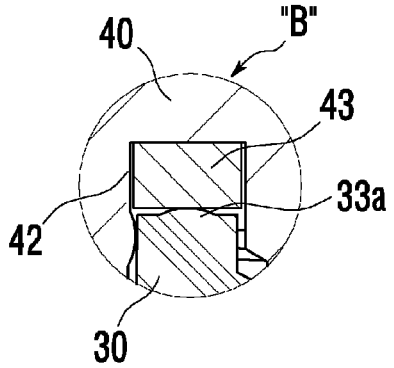

[Fig. 8]
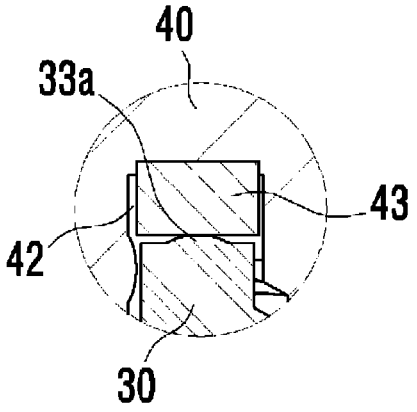
[Fig. 9]
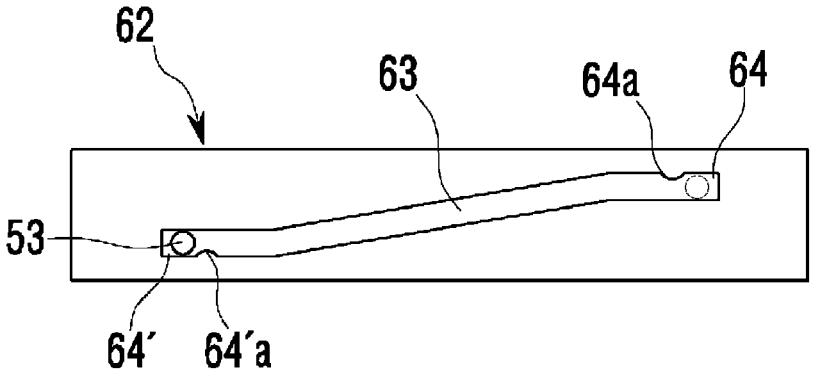
[Fig. 10]
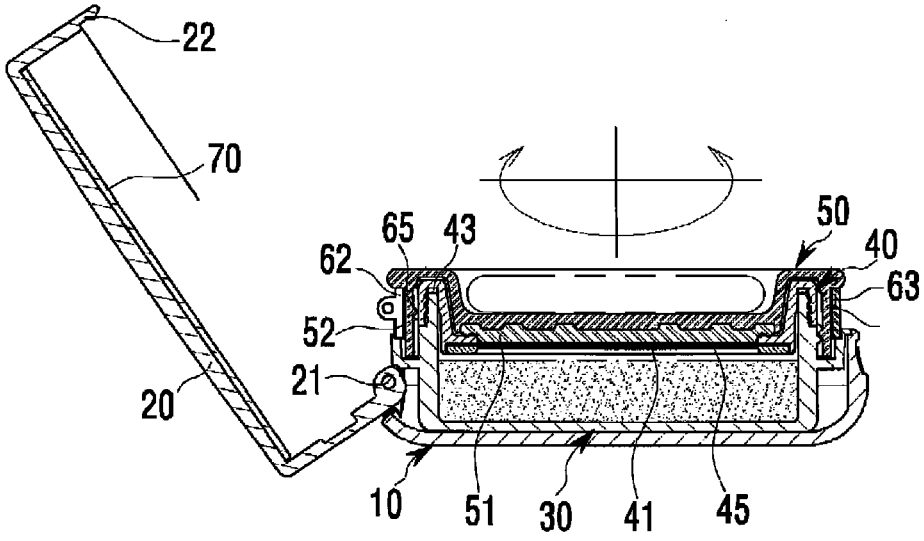

[Fig. 11]
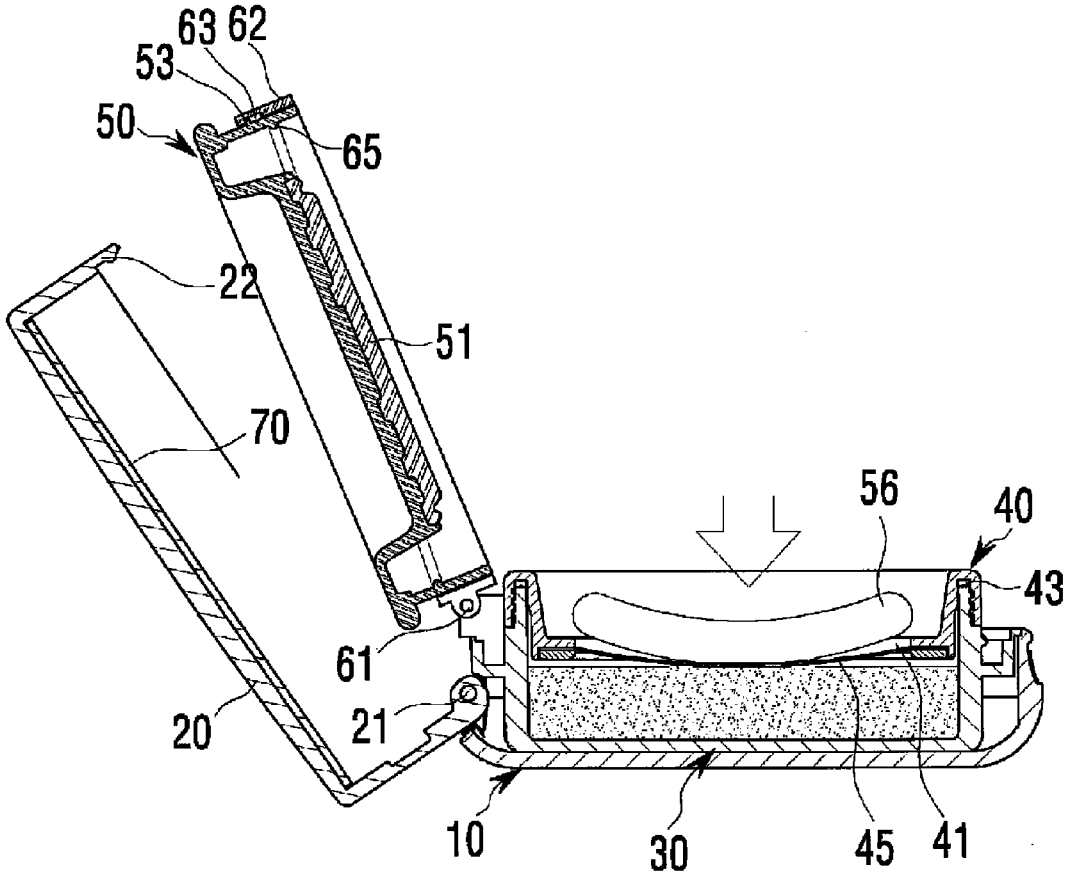

COMPACT TYPE OF AIRTIGHT COSMETIC CONTAINER

TECHNICAL FIELD

The present invention relates, in general, to compact type of airtight cosmetic containers which contain cosmetics such as dry or wet powder, pressed powder or liquid foundation therein, and are configured to be sealed so as to prevent the cosmetics from changing and, more particularly, to a compact type of airtight cosmetic container in which a shoulder cap to which a mesh is coupled, and a puff storage cap which stores a puff, are successively placed onto and coupled to a medial body which contains a cosmetic therein, wherein the shoulder cap and the puff storage cap can be airtightly coupled to the medial body by a sealing member provided under the puff storage cap and a sealing ring provided in the lower surface of the shoulder cap, and a pressurizing means pressurizes the puff storage cap onto the medial body such that the sealing member and the sealing ring are compressed, whereby the sealability of the cosmetic container can be enhanced so that leakage of powder or a cosmetic change attributable to water evaporation can be reliably prevented despite having a compact container structure.

BACKGROUND ART

Generally, cosmetic containers, referred to as compacts, are used to contain different kinds of powder-type cosmetics such as dry or wet powder, pressed powder or liquid foundation. These compacts have a variety of sealing structures to prevent leakage of powder or cosmetic change attributable to water evaporation. Such conventional cosmetic containers are well-known in various shapes.

For example, in a conventional technique proposed in Korean Patent Registration No. 10-1073416, a shoulder cap provided with a mesh is coupled to a through hole formed in a central portion of a body which contains a cosmetic, and a sealing member is provided under a lower surface of an upper cap to airtightly seal the mesh of the shoulder cap. However, this structure can be used only in the case where the cosmetic container is provided with no puff. Furthermore, this technique cannot provide sufficient sealability.

In addition, a structure in which a puff storage cap which stores a puff therein is coupled to an upper portion of a shoulder cap provided with a mesh was introduced in Korean Utility Model Registration No. 20-423018. However, in this technique, it is difficult to airtightly seal the mesh of the shoulder cap. Therefore, this technique cannot prevent leakage of powder or a change of cosmetic attributable to water evaporation.

Moreover, the above-mentioned cosmetic containers are basic powder containers having a simple structure such that the upper cap is threadedly coupled to the upper portion of the body. Upper and lower bodies are openably coupled at a predetermined position to each other by a hinge. The medial body which contains the cosmetic therein is disposed in the lower body. The shoulder cap, which is provided with the mesh coupled to the through hole formed in the central portion of the shoulder cap, and the puff storage cap, which stores the puff therein, are coupled to the upper portion of the medial body. In the case of the conventional compact cosmetic container having this structure, it is more difficult to apply the sealing structure to the cosmetic container. There are several structural problems in sealing the cosmetic container that contains the cosmetic such as dry or wet powder, pressed powder or liquid foundation.

DISCLOSURE OF INVENTION

Technical Problem

Accordingly, the present invention has been made keeping in mind the above problems occurring in the prior art, and an object of the present invention is to provide a compact type of airtight cosmetic container which contains a cosmetic such as dry or wet powder, pressed powder or liquid foundation therein, and in which a shoulder cap to which a mesh is coupled, and a puff storage cap which stores a puff, are successively placed onto and coupled to a medial body which contains the cosmetic therein, wherein the shoulder cap and the puff storage cap can be airtightly coupled to the medial body by a sealing member provided under the puff storage cap and a sealing ring provided in the lower surface of the shoulder cap, and a pressurizing means pressurizes the puff storage cap onto the medial body such that the sealing member and the sealing ring are compressed, whereby the sealability of the cosmetic container can be enhanced so that leakage of powder or a cosmetic change attributable to water evaporation can be reliably prevented.

Another object of the present invention is to provide a compact type of airtight cosmetic container in which the pressurizing means provided to pressurize the puff storage cap has a simple structure and is operated by a simple manipulation method.

A further object of the present invention is to reinforce the coupling structures of the sealing member, the sealing ring and the mesh.

Solution to Problem

In order to accomplish the above objects, the present invention provides a compact type of airtight cosmetic container, including: a lower body; an upper body openably coupled to an upper portion of the lower body by a hinge disposed at a first side, the upper body releasably locked to the lower body by a locker disposed at a second side; a medial body provided in the lower body to contain a dry or wet powder or liquefied powder cosmetic therein; a shoulder cap disposed in and coupled to an upper portion of the medial body, the shoulder cap having a through hole in a central portion thereof, with an elastic mesh fastened by a fastening ring to a lower surface of a circumferential portion of the shoulder cap that defines the through hole; and a puff storage cap disposed in and coupled to an upper portion of the shoulder cap, the puff storage cap having a center space in a central portion of an upper portion of the puff storage cap so that a puff is received in the center space, wherein a sealing member is provided under the puff storage cap, the sealing member airtightly sealing the through hole of the shoulder cap, and a sealing ring is installed in a seating depression of the shoulder cap that is fitted over a circumferential outer surface of an upper end of the medial body, and wherein pressurizing means pressurizes the puff storage cap onto the medial body so that the sealing member and the sealing ring are compressed, thus enhancing sealability.

The pressurizing means may include: a support ring coupled to a predetermined portion of a perimeter of the upper portion of the medial body by a hinge so as to be rotatable upwards or downwards; a guide ring provided under a perimeter of the puff storage cap, the guide ring being disposed in the support ring; and a threaded part threadedly coupling the guide ring to the medial body, wherein a spiral guide groove and a guide protrusion that correspond to each other are respectively provided on a circumferential inner surface of the support ring and a circumferential outer surface of the guide ring, wherein when the puff storage cap is rotated, a thread tightening type of pressurizing operation or a thread loosening type of releasing operation is conducted in such a way that the guide protrusion is guided along the guide groove.

Furthermore, upper and lower horizontal guide grooves may respectively extend from upper and lower ends of the guide groove so that the guide protrusion is horizontally inserted into and guided by the upper or lower horizontal guide groove, and a locking protrusion may be provided in each of the upper and lower horizontal guide grooves so that when the guide protrusion is locked to the locking protrusion, the puff storage cap is maintained in a state of the thread tightening type of pressurizing operation or a thread loosening type of releasing operation.

The sealing member may include: a first pressing part inserted into the through hole of the shoulder cap, the first pressing part pressurizing a circumferential inner edge of the through hole; and a second pressing part pressurizing an upper surface of the circumferential portion that defines the through hole.

In addition, a knurled surface may be formed on a circumferential outer surface of the shoulder cap to prevent slip when rotating the shoulder cap.

The shoulder cap that is coupled to the upper portion of the medial body may open or airtightly close the medial body in a threaded coupling manner using a threaded coupling part.

Advantageous Effects of Invention

In a compact type of airtight cosmetic container according to the present invention, a shoulder cap to which a mesh is coupled and a puff storage cap which stores a puff are successively placed onto and coupled to a medial body which contains a cosmetic therein. The shoulder cap and the puff storage cap can be airtightly coupled to the medial body by a sealing member provided under the puff storage cap and a sealing ring provided in the lower surface of the shoulder cap. Further, a pressurizing means pressurizes the puff storage cap onto the medial body such that the sealing member and the sealing ring are compressed so that the sealability of the cosmetic container can be enhanced. Therefore, leakage of powder or a cosmetic change attributable to water evaporation can be reliably prevented.

Furthermore, the pressurizing means which pressurizes the puff storage cap has a simple structure and is able to be manipulated by a simple method, whereby the manufacturing productivity is enhanced, and it is convenient to use.

In addition, the coupling structures of the sealing member, the sealing ring and the mesh are reliable. Thus, the durability of the cosmetic container is enhanced.

Moreover, the medial body which contains the cosmetic therein opens or closes in such a way that the shoulder cap is coupled to or removed from the medial body, and the airtightness therebetween is ensured by the sealing ring. Therefore, even when the cosmetic container is refilled with a cosmetic, water evaporation or cosmetic leakage can be reliably prevented, and the cosmetic can be reliably prevented from changing, thus making it possible to maintain the quality of the cosmetic for a long period of time.

BRIEF DESCRIPTION OF DRAWINGS

FIG. 1 is a perspective view illustrating an assembled cosmetic container, according to the present invention;

FIG. 2 is an exploded perspective view of the cosmetic container of FIG. 1;

FIG. 3 is a perspective view showing a critical portion of the cosmetic container of FIG. 2;

FIG. 4 is a sectional view of the assembled cosmetic container according to the present invention;

FIG. 5 is an enlarged sectional view of circle portion "A" of FIG. 4;

FIG. 6 is a partial enlarged sectional view showing a shoulder cap of the cosmetic container according to the present invention;

FIG. 7 is an enlarged sectional view of circle portion "B" of FIG. 6;

FIG. 8 is a sectional view showing another embodiment of FIG. 7;

FIG. 9 is a front view illustrating the operational principle of a pressurizing means according to the present invention; and FIGS. 10 and 11 are views showing the operation of the cosmetic container of the present invention.

BEST MODE FOR CARRYING OUT THE INVENTION

Hereinafter, a preferred embodiment of the present invention will be described in detail with reference to the attached drawings.

As shown in FIGS. 1 through 9, a compact type of airtight cosmetic container according to the present invention includes a lower body 10, an upper body 20, a medial body 30, a shoulder cap 40 and a puff storage cap 50. The upper body 20 is openably coupled to an upper portion of the lower body 10 by a hinge 21 disposed at a first side. The upper body 20 is releasably locked to the lower body 10 by a locker 22 disposed at a second side. The medial body 30 is provided in the lower body 10 to contain a dry or wet powder or liquefied powder cosmetic therein. The shoulder cap 40 is disposed in and coupled to an upper portion of the medial body 30. The shoulder cap 40 has a through hole 41 in a central portion thereof. A mesh 45 having elasticity is fastened by a fastening ring 46 to a lower surface of a portion of the shoulder cap 40 that defines the through hole 41. The puff storage cap 50 is disposed in and coupled to an upper portion of the shoulder cap 40. A center space 55 is defined in a central portion of an upper portion of the puff storage cap 50 so that a puff 56 is received in the center space 55.

A sealing member 51 which seals the through hole 41 of the shoulder cap 40 is coupled to a lower portion of the puff storage cap 50. A sealing ring 43 is disposed in a seating depression 42 of the shoulder cap 40 which is fitted over a circumferential outer surface of the upper end of the medial body 30. A pressurizing means 60 pressurizes the puff storage cap 50 onto the medial body 30 so that the sealing member 51 and the sealing ring 43 are compressed, whereby the sealability of the cosmetic container can be enhanced.

The pressurizing means 60 includes a support ring 62 which is coupled to a predetermined portion of the perimeter of the upper portion of the medial body 30 by a hinge 61 so as to be rotatable upwards or downwards, a guide ring 52 which is integrally provided under the perimeter of the puff storage cap 50 and disposed in the support ring 62, and a threaded part 65 which threadedly couples the guide ring 52 to the medial body 30. A spiral guide groove 63 and a guide protrusion 53 which correspond to each other are respectively provided on a circumferential inner surface of the support ring 62 and a circumferential outer surface of the guide ring 52. When the puff storage cap 50 is rotated in one direction, a thread tightening type of pressurizing operation or a thread loosening type of releasing operation are conducted in such a way that the guide protrusion 53 is guided along the guide groove 63.

Horizontal guide grooves 64 and 64' respectively extend from upper and lower ends of the guide groove 63 so that the guide protrusion 53 is horizontally inserted into and guided by the horizontal guide groove 64 or 64'. Locking protrusions 64*a* and 64'*a* are respectively provided in the horizontal guide grooves 64 and 64'. When the guide protrusion 53 is locked to the locking protrusion 64*a* or 64'*a*, the puff storage cap 50 is maintained in the state of the thread tightening type of pressurizing operation or a thread loosening type of releasing operation.

The sealing member 51 includes a first pressing part 51*a* which is inserted into the through hole 41 of the shoulder cap 40 and pressurizes the circumferential inner edge of the through hole 41, and a second pressing part 51*b* which pressurizes the upper surface of the portion defining the through hole 41. The sealing member 51 may be coupled to a lower surface of the puff storage cap 50 through a separate assembly process. Alternatively, the sealing member 51 may be integrally provided in the lower surface of the puff storage cap 50 by insert molding.

As shown in FIG. 7, the sealing ring 43 may be provided in the seating depression 42 of the shoulder cap 40 through a separate insert assembly process or, alternatively, as shown in FIG. 8, it may be integrally provided in the seating depression 42 by insert molding.

Here, a pressurization protrusion 33*a* is provided on an upper circumferential edge of the medial body 30 at a position corresponding to the sealing ring 43 so as to enhance the sealability.

In the drawings, reference numeral 40*a* denotes an anti-slip knurled surface which is formed on a circumferential outer surface of the shoulder cap 40 so as to prevent slipping when rotating the shoulder cap 40. Reference numeral 49 denotes a threaded coupling part of the shoulder cap 40. Reference numeral 70 denotes a mirror.

The operation and effect of the present invention having the above-mentioned construction will be explained below.

The purpose of the present invention is to provide airtightness to the compact cosmetic container. In the compact cosmetic container, the lower body 10 and the upper body 20 open or shut in such a way that the lower and upper bodies 10 and 20 are rotated upwards or downwards around the hinge 21 with respect to each other. Further, the lower and upper bodies 10 and 20 are locked to or released from each other by the locker 22 that is disposed at a position opposite to the hinge 21. The medial body 30 which contains a cosmetic such as dry or wet powder, pressed powder, liquid foundation, etc., the shoulder cap 40 which is provided with the mesh 45 coupled to the through hole 41 formed in the shoulder cap 40, and the puff storage cap 50 which stores the puff 56 are successively placed in the lower body 10.

That is, the through hole 41 of the shoulder cap 40 is sealed by the sealing member 51 provided under the puff storage cap 50. The circumferential upper edge of the medial body 30 is sealed by the sealing ring 43 disposed in the seating depression 42 of the shoulder cap 40.

Moreover, the sealing member 51 and the sealing ring 43 are compressed by the pressurizing means 60, whereby the sealability can be further enhanced.

The operation of the pressurizing means 60 will now be explained in more detail. The guide ring 52 which is integrally provided under the perimeter of the puff storage cap 50 is threadedly coupled to the medial body 30, and the puff storage cap 50 is threadedly coupled to the medial body 30 by the threaded part 65. Then, the sealing member 51 provided under the puff storage cap 50 is compressed so that the through hole 41 of the shoulder cap 40 is airtightly sealed, and the sealing ring 43 installed in the seating depression 42 of the shoulder cap 40 is also compressed such that the circumferential edge of the upper end of the medial body 30 is airtightly sealed.

Here, the guide protrusion 53 provided on the circumferential outer surface of the guide ring 52 of the puff storage cap 50 is guided downwards by the spiral guide groove 63 formed in the circumferential inner surface of the support ring 62.

That is, the guide protrusion 53 is guided downwards along the guide groove 63 and then locked to the locking protrusion 64'*a* of the horizontal guide groove 64' formed in the lower end of the guide groove 63 so that the guide protrusion 53 is prevented from being removed from the horizontal guide groove 64'. Thereby, the thread tightening type of pressurizing operation of the puff storage cap 50 can be maintained.

Furthermore, the sealing member 51 has a double sealing structure configured such that the first pressing part 51*a* inserted into the through hole 41 of the shoulder cap 40 presses the circumferential inner edge of the through hole 41, and the second pressing part 51*b* provided around the first pressing part 51*a* presses the upper surface of the portion of the shoulder cap 40 that defines the through hole 41. Thereby, the through hole 41 of the shoulder cap 40 can be more reliably sealed.

As such, the upper end of the medial body can be reliably sealed by the operation of pressing the sealing member 51 and the sealing ring 43 so that powder can be prevented from leaking out of the container or the cosmetic can be prevented from changing, for example, due to water evaporation.

In order to use the cosmetic that is contained in the cosmetic container that has been airtightly sealed, as shown in FIGS. 10 and 11, a user unlocks the locker 22 of the upper body 20 and rotates the upper body 20 around the hinge 21 to open it. Thereafter, the user reversely rotates the puff storage cap 50 to loose the threaded coupling thereof.

At this time, the guide protrusion 53 provided on the circumferential outer surface of the guide ring 52 of the puff storage cap 50 is moved upwards under the guidance of the spiral guide groove 63 formed in the circumferential inner surface of the support ring 62.

In other words, the guide protrusion 53 is guided upwards along the guide groove 63 and locked to the locking protrusion 64*a* of the horizontal guide groove 64 formed on the upper end of the upper end of the guide groove 63 so that the guide protrusion 53 is prevented from being removed from the horizontal guide groove 64. Thereby, the threaded coupling released state of the puff storage cap 50 can be maintained.

In this state, the user rotates the puff storage cap 50 and the support ring 62 around the hinge 61 to open it. Subsequently, the user uses the puff 56 and pushes the elastic mesh 45, which is disposed in the central portion of the shoulder cap 40, so that the cosmetic such as dry or wet powder, pressed powder or liquid foundation which is contained in the medial body 30 can be applied to the puff 56.

To refill the medial body 30 with a cosmetic, the user rotates the upper body 20 around the hinge 21 to open it and also rotates the puff storage cap 50 upwards around the hinge 61 to open it. In this state, the user loosens the threaded coupling of the threaded coupling part 49 of the shoulder cap 40 and opens the shoulder cap 40.

As such, after the medial body 30 is opened by opening the shoulder cap 40, the medial body 30 is allowed to be filled with one of different kinds of cosmetics. After the medial body 30 has been refilled with the cosmetic, the shoulder cap 40 is threadedly coupled to the medial body 30. Then, the cosmetic contained in the medial body 30 can be reliably sealed again by the sealing ring 43.

As described above, the present invention provides a compact cosmetic container which is configured such that, no matter what kind of cosmetic such as dry or wet powder, pressed powder or liquid foundation is contained in a medial body, leakage of powder or water evaporation can be prevented, whereby the cosmetic can be prevented from changing, and the high quality of the cosmetic can be maintained for a long period of time.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A compact type of airtight cosmetic container, comprising:

a lower body, an upper body openably coupled to an upper portion of the lower body by a hinge disposed at a first side, the upper body releasably locked to the lower body by a locker disposed at a second side;

a medial body provided in the lower body to contain a dry or wet powder or liquefied powder cosmetic therein;

a shoulder cap disposed in and coupled to an upper portion of the medial body, the shoulder cap having a through hole in a central portion thereof, with an elastic mesh fastened by a fastening ring to a lower surface of a circumferential portion of the shoulder cap that defines the through hole; and a puff storage cap disposed in and coupled to an upper portion of the shoulder cap, the puff storage cap having a center space in a central portion of an upper portion of the puff storage cap so that a puff is received in the center space, wherein a sealing member is provided under the puff storage cap, the sealing member airtightly sealing the through hole of the shoulder cap, and a sealing ring is installed in a seating depression of the shoulder cap that is fitted over a circumferential outer surface of an upper end of the medial body, and wherein the puff storage cap is pressurized onto the medial body so that the sealing member and the sealing ring are compressed, thus enhancing sealability, using:

a support ring coupled to a predetermined portion of a perimeter of the upper portion of the medial body by a hinge so as to be rotatable upwards or downwards;

a guide ring provided under a perimeter of the puff storage cap, the guide ring being disposed in the support ring; and a threaded part threadedly coupling the guide ring to the medial body, wherein a spiral guide groove and a guide protrusion that correspond to each other are respectively provided on a circumferential inner surface of the support ring and a circumferential outer surface of the guide ring, wherein when the puff storage cap is rotated, a thread tightening type of pressurizing operation or a thread loosening type of releasing operation is conducted in such a way that the guide protrusion is guided along the guide groove.

2. The compact type of airtight cosmetic container according to claim 1, wherein upper and lower horizontal guide grooves respectively extend from upper and lower ends of the guide groove so that the guide protrusion is horizontally inserted into and guided by the upper or lower horizontal guide groove, and a locking protrusion is provided in each of the upper and lower horizontal guide grooves so that when the guide protrusion is locked to the locking protrusion, the puff storage cap is maintained in a state of the thread tightening type of pressurizing operation or a thread loosening type of releasing operation.

3. The compact type of airtight cosmetic container according to claim 1, wherein the sealing member comprises:

a first pressing part inserted into the through hole of the shoulder cap, the first pressing part pressurizing a circumferential inner edge of the through hole; and a second pressing part pressurizing an upper surface of the circumferential portion that defines the through hole.

4. The compact type of airtight cosmetic container according to claim 1, wherein a knurled surface is formed on a circumferential outer surface of the shoulder cap to prevent slip when rotating the shoulder cap.

5. The compact type of airtight cosmetic container according to claim 1, wherein the shoulder cap that is coupled to the upper portion of the medial body opens or airtightly closes the medial body in a threaded coupling manner using a threaded coupling part.

* * * * *